US006002294A

United States Patent [19]

Kushibe

[11] Patent Number: 6,002,294

[45] Date of Patent: Dec. 14, 1999

[54] START CIRCUIT FOR A SELF-BIASING CONSTANT CURRENT CIRCUIT, CONSTANT CURRENT CIRCUIT AND OPERATIONAL AMPLIFIER USING THE SAME

[75] Inventor: Hidefumi Kushibe, Kamakura, Japan

[73] Assignee: Kabushiki Kaisha Toshiba, Kawasaki, Japan

[21] Appl. No.: 08/969,609

[22] Filed: Nov. 13, 1997

[30] Foreign Application Priority Data

Nov. 13, 1996 [JP] Japan ..... 8-302130

[51] Int. Cl.[6] ..... G05F 1/10

[52] U.S. Cl. ..... 327/543; 327/540; 327/541

[58] Field of Search ..... 327/538, 545, 327/543, 546, 539, 540, 541; 323/312, 315

[56] References Cited

U.S. PATENT DOCUMENTS 5,034,626 7/1991 Pirez et al. ..... 307/296.7

5,744,999 4/1998 Kim et al. ..... 327/543

5,777,504 7/1998 Chu et al. ..... 327/379

5,825,237 10/1998 Ogawa ..... 327/545

*Primary Examiner*—Timothy P. Callahan

*Assistant Examiner*—An T. Luu

*Attorney, Agent, or Firm*—Oblon, Spivak, McClelland, Maier & Neustadt, P.C.

[57] ABSTRACT

There are provided a start circuit for a constant current circuit, a constant current circuit including the start circuit, and an operational amplifier including the constant current circuit. When an output stop signal PD changes from an inactivation mode to an activation mode, changes of transistors MN3 and MP6 to their off states are delayed for a moment by a delay circuit DL or a switch SW1 to temporarily lower the bias node and to reliably start the circuit. Therefore, the circuit does not need a large capacitor and prevents entry of noise through the capacitor.

14 Claims, 8 Drawing Sheets

START CIRCUIT FOR A SELF-BIASING CONSTANT CURRENT CIRCUIT, CONSTANT CURRENT CIRCUIT AND OPERATIONAL AMPLIFIER USING THE SAME

BACKGROUND OF THE INVENTION

1. Field of the Invention

This invention relates to a start circuit for a self-biasing constant current circuit, a constant current circuit and an operational amplifier using the start circuit, especially suitable for use in analog ASIC, for example.

2. Discussion of the Background

There is a great demand for on ASIC (Application Specific Integrated Circuit), which is an integrated circuit originally having standard circuit elements on a substrate and permitting the circuit arrangement to be freely modified according to a specific wiring design pursuant to a client's request. There are analog ASICs intended for analog circuits including logic circuits, constant current circuits, operational amplifiers, and so forth.

A constant current circuit with a high reliability is indispensable for stabilizing operations of an analog circuit.

A general construction of a conventional self-biasing constant circuit device is shown in FIG. 7 where a p-channel MOS transistor MP1 and an n-channel MOS transistor MN1 are connected in series between a power source $V_{DD}$ and the ground GND, and a p-channel MOS transistor MP2, resistor R1, and n-channel MOS transistor MN2 connected in series are connected in parallel with the transistors MP1 and MN1. The gate of the transistor MP1 and the gate of the transistor MP2 are commonly connected to a bias point VB. Connected between the common connected point and the drain of the transistor MP1 is a transistor MP3 whose gate is supplied with a power down signal PD.

The gate of the transistor MN1 is connected to the connection point of the drain of the transistor MN2 and the resistor R1, and the gate of the transistor MN2 is connected to the connection point of the drain of the transistor MP2 and the resistor R1.

Further provided are a transistor MP4 with the source connected to $V_{DD}$ and the drain connected to the gate common connection point and supplied to the gate with the signal PDB inverted from the power down signal, and a p-channel MOS transistor MP5 with the source connected to the power source $V_{DD}$ and the drain connected to a load-connected terminal T. Since the transistors MP1 and MP5 form a current mirror circuit, the current I1 flowing in the transistor MP1 and the current I2 flowing in the transistor MP5 are equal, and a constant current flows in the load connected between the load-connected terminal and the ground.

The transistor MP3 supplied with the power down signal PD to the gate and the transistor MP4 supplied to the gate with the signal PDB inverted from the power down signal behave as a switch for starting or stopping the operation of the constant current circuit.

Explained below are behaviors of the circuit. Let an appropriate load be connected to the load-connected terminal T.

In operation, the transistor MP3 is turned on with an "H" level signal applied as the power down signal PD to its gate, and the transistor MP4 is turned off with an "L" level signal applied to its gate. As a result, the transistors MP1, MP2 and MN2 are also turned on. It causes a current Ir to flow in the resistor R1, which in turn causes the current I1 to flow in the transistor MP1 and the current I2 to flow in the transistor MP5 paired with the transistor MP1 to form the current mirror.

On the other hand, in the inoperative state, since an "L" level signal is supplied as the power down signal PD and an "H" level signal as the signal PDB, the transistor MP3 is turned off and the transistor MP4 is turned on, which causes the bias potential VB to elevate to the source voltage $V_{DD}$, and the transistors MP1 and MP2 are turned off, which results in no flow of the current through R1 and no flow of the constant current. In this state, the drain voltages of the transistors MP1, MP2 and MP3 are $V_{SS}$.

However, since the drain voltages of the transistors MP1, MP2 and MP3 are $V_{SS}$ in the inoperative state, even when the circuit is changed to the operative state by turning the transistor MP3 on and MP4 off, the transistors MP1 and MP2 remain off, no current flows in the circuit, and the bias circuit does not function.

To overcome the problem, it has been proposed to connect a capacitor C1 between the power-down signal terminal PD and the bias point VB to use it as a start circuit and to use its capacitance for forcibly lowering the bias point.

However, in the start circuit in the conventional self-biasing constant current circuit shown in FIG. 8, since the bias point VB is connected to the part of $V_{SS}$ via the capacitor C1 in the operative state, noise, if any, contained in the power on the part of $V_{SS}$ may be contained in VB through the capacitor C1. In this case, the PSRR (Power Source Reduction Ratio) characteristic of the circuit, namely, the ratio of change in output voltage responsive to the source voltage, may deteriorate.

Moreover, when a number of gates or other capacities which apply loads are connected to the bias point, a large capacitance is required for reliably starting the circuit, which inevitably causes the capacitance to occupy a large area. For example, if the load is several times pF, then the capacitance of the capacitor must be several times the value, namely, as large as 20 pF, for example. Thus, the area occupied by the capacitor to ensure the capacitance becomes very large, and degrades the efficiency of the device in terms of its area.

SUMMARY OF THE INVENTION

It is therefore an object of the invention to provide a start device of a self-biasing constant current circuit, a constant current circuit and an amplifier using the start device, which reliably prevents deterioration in PSRR characteristic and prevents an increase in occupied area.

According to the invention, there is provided a start circuit for a self-biasing constant current circuit including first and second MOS transistors of same conduction type with commonly connected gates to form a current mirror circuit, and bias setting means for setting the potential of a common connection point of the gates of the first and second MOS transistors to a predetermined bias potential; in which the start circuit includes a control transistor for controlling the potential of the common connection point; and control means for controlling said control transistor in such a manner that said control transistor is placed in a low impedance state to once pull down the potential of said common connection point to a reference potential for starting the constant current circuit and then placed in a high impedance state.

In the start circuit of the constant current circuit, although the drain of the third transistor becomes "L" when an output stop signal PD changes from "H" to "L" to change the circuit from its inactivated state to the activated state, the gate of the third n-channel MOS transistor maintains "H" and lowers VB to "L" due to the existence of the delay circuit. The gate of the third n-channel transistor changes to "L" after the delay time, and causes the transistor to turn off. As a result, the bias node is changed to "L", and a current flows in the self-biasing circuit to start the circuit.

In the start circuit having the above-explained construction, no deterioration in PSRR occurs because no capacitance is used on the part of VSS and in the bias node, and the use of the transistor to lower the bias node removes the need for a large capacitance as conventionally required, and prevents an increase of the area for the capacitance.

Such features are also applicable to a constant current circuit including the start circuit and an operational amplifier including the constant current circuit.

DETAILED DESCRIPTION OF THE PREFERRED EMBODIMENTS

Some embodiments of the invention are described below with reference to the drawings.

Figure 1:
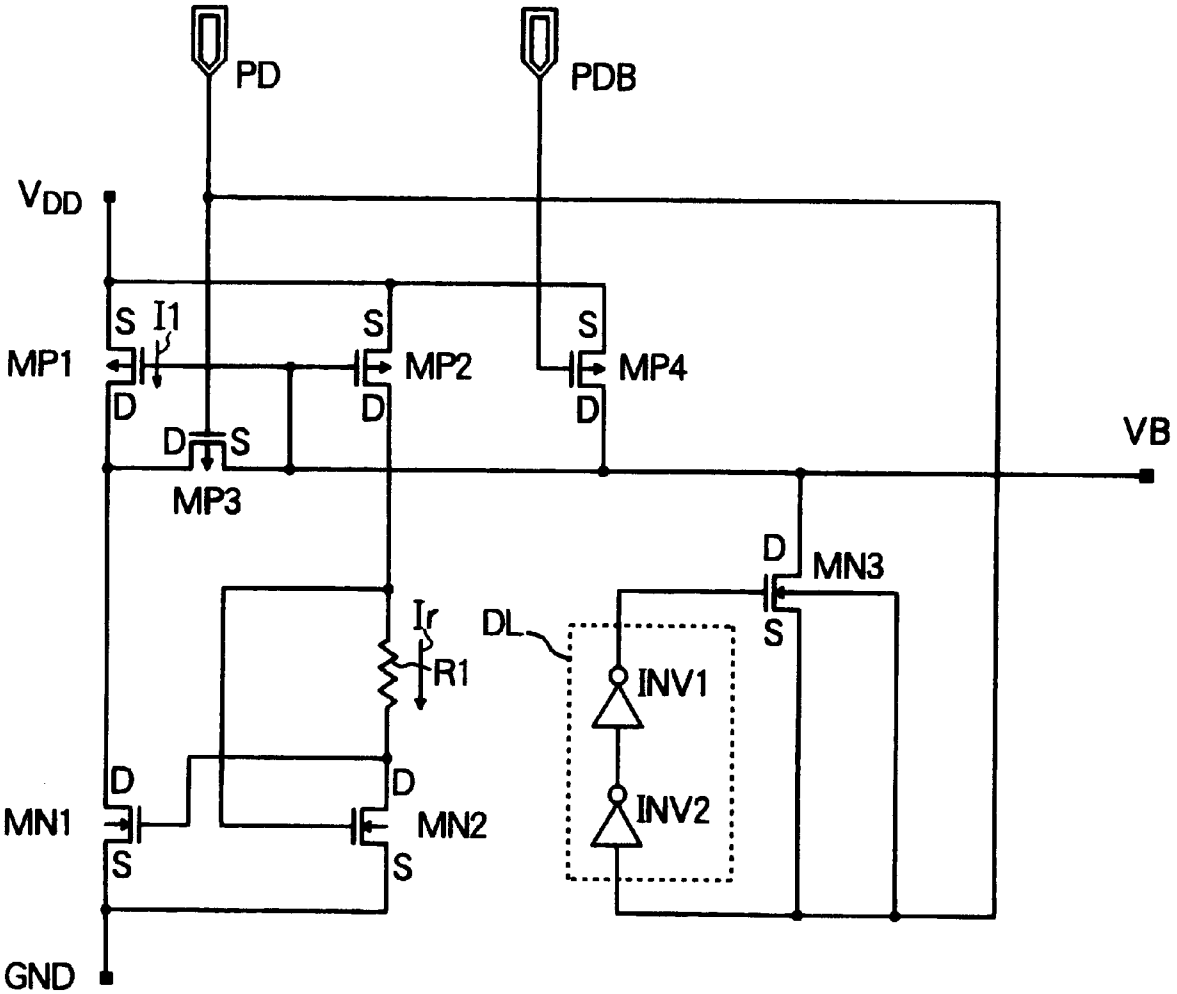
FIG. 1 is a circuit diagram showing the construction of a start device of a constant current circuit, according to the first embodiment of the invention.

FIG. 1 shows the construction of a start device of a self-biasing constant current circuit, taken as the first embodiment of the invention. Elements or components in FIG. 1 identical to those of FIG. 8 are labelled with common reference numerals, and their detailed explanations are omitted.

Figure 8:
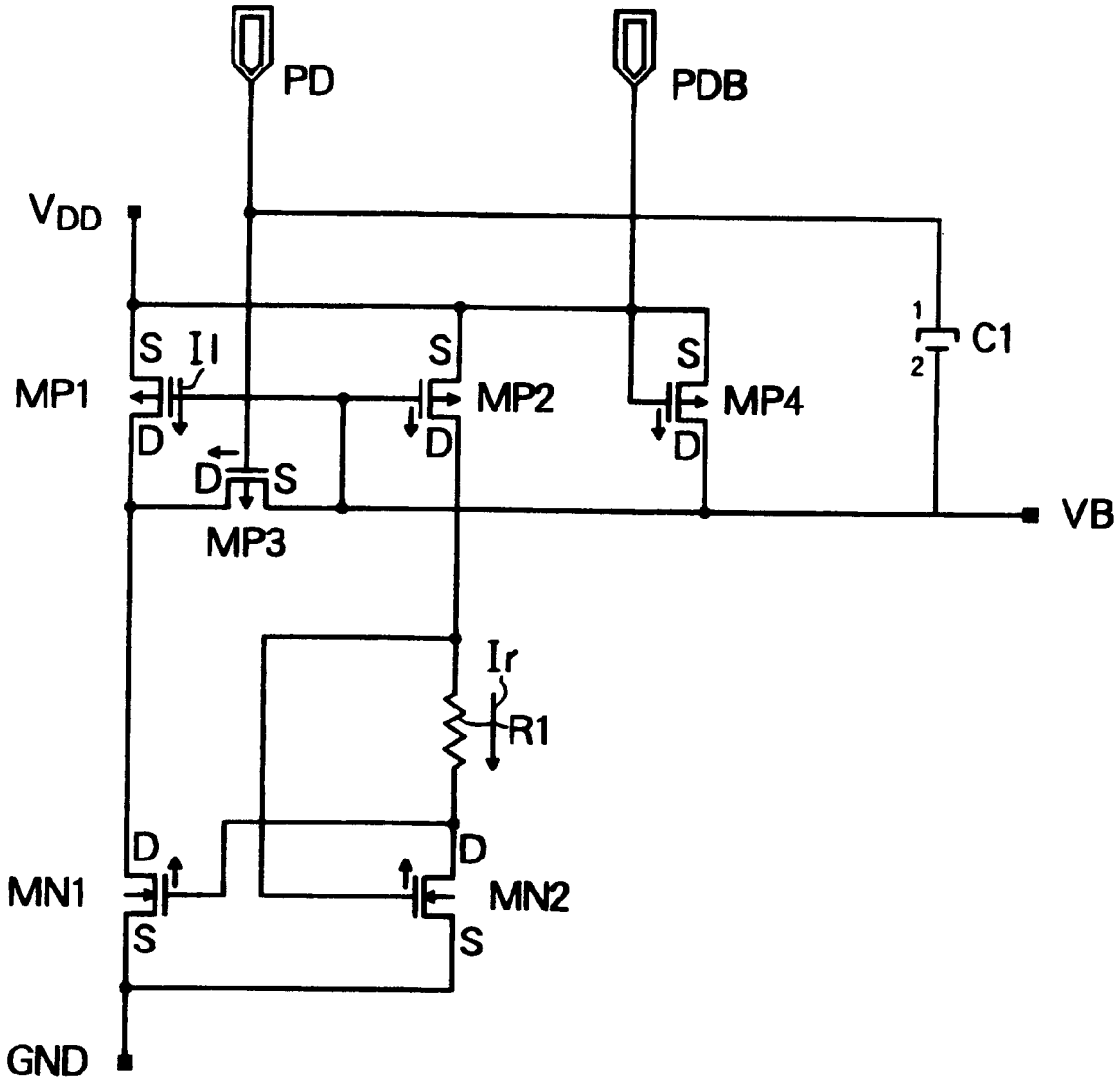
FIG. 8 PRIOR ART
FIG. 8 is a circuit diagram showing the construction modified from the circuit of FIG. 7 for enabling smooth start of the circuit.

FIG. 1 is different from FIG. 8 in that, instead of using the capacitor C1 in FIG. 8, the circuit of FIG. 1 uses an n-channel MOS transistor, connecting its drain to the bias node VB, connecting the power down signal PD to the source of MN3 and the substrate, and connecting to the gate of the transistor MN3 a signal derived from the power-down signal PD introduced through a delay circuit DL including two serially connected inverters INV1 and INV2.

Explained below are behaviors of the circuit.

In the power-down state where PD="H" and PDB="L", the transistor MP3 is turned off and MP4 is turned on. In this status, VB="H", and no current flows in the circuit.

When PD is switched from "H" to "L", and PDB from "L" to "H", to activate the circuit to generate a constant current, although the source of the transistor MN3 and the substrate are changed to "L", the gate maintains "H" during the delay time given by the delay circuit DL. Therefore, the bias potential VB is pulled down to the "L" potential. As a result, the transistors MP1 and MP2 are turned on, and a current begins to flow in the circuit. After the delay time, the gate of the transistor MN3 is changed to "L", resulting in turning off the transistor MN3, and the bias potential VB is stabilized in its constant value.

When PD changes from "L" to "H" and PDB from "H" to "L", which causes the source of the transistor MN3 and the substrate to change to "H" and the gate to change from "L" to "H" after the delay time, then MN3 is turned off in this period. Therefore, the circuit is immediately changed to the power-down status.

As explained above, this embodiment makes it possible to start the circuit with no capacitance connected between $V_{SS}$ and VB, any noise in $V_{SS}$ does not affect VB, and no deterioration occurs in PSRR characteristics. Moreover, since transistors lower the bias node, the circuit does not require a large capacitance as used conventionally, and can decrease the area as well.

Figure 2:
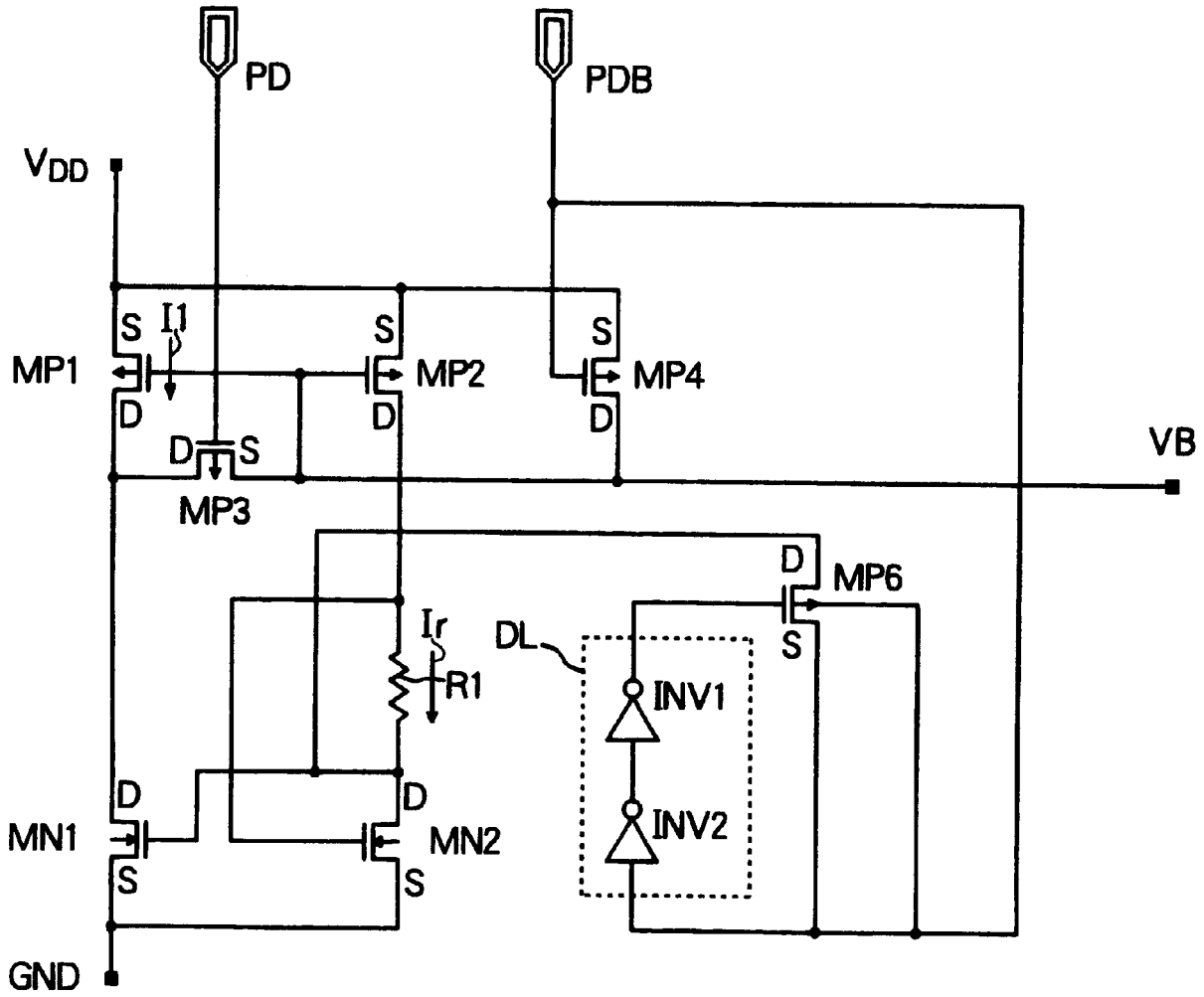
FIG. 2 is a circuit diagram showing the construction of a start device of a constant current circuit, according to the second embodiment of the invention.

FIG. 2 shows the construction of a start device of a self-biasing constant current circuit, taken as the second embodiment of the invention.

This embodiment uses a p-channel MOS transistor MP6, connecting its drain to the gate of the transistor MN1, applying the power-down signal PDB to its source and the substrate, and applying to the gate a signal derived from PDB introduced through the delay circuit DL.

Explained below are behaviors of the circuit.

In the power-down status where PD="H" and PDB="L", the transistor MP3 is turned off and MP4 is turned on. In this status, VB="H", and no current flows in the circuit.

When PD changes from "H" to "L" and PDB from "L" to "H", although the source of the transistor MP6 and the substrate are changed to "H", the gate maintains "H" during the delay time given by the delay circuit. Thus, the transistor MP6 is turned on, causing the transistor MN1 to be turned on and causing a current to flow in the transistor MP1 as well. Therefore, the circuit is turn off, and a current begins to flow. After the delay time, the gate of the transistor MP6 changes to "H", and the bias node VB is stabilized in its constant value.

When Pd changes from "L" to "H" and PDB from "H" to "L", since the source of the transistor MP5 and the substrate are changed to "L", and the gate changes from "H" to "L" after the delay time, MP5 is turned off in this period. Therefore, the circuit is immediately changed to the power-down status.

This embodiment can start the circuit with no capacitance connected between $V_{SS}$ and VB, and can hold VB free from noise in $V_{ss}$, if any. Therefore, no deterioration occurs in PSRR characteristics. Moreover, since transistors lowers the bias node, the circuit does not require a large capacitance as required conventionally, and need not increase the area.

Although the delay circuit, in any of FIGS. 1 and 2, includes two-step inverters for making the delay time, inverters of any even number of steps can be used provided an appropriate delay time, 1 ns, for example, can be realized. It is also possible to make the delay circuit from a resistor and a capacitance.

Figure 3:
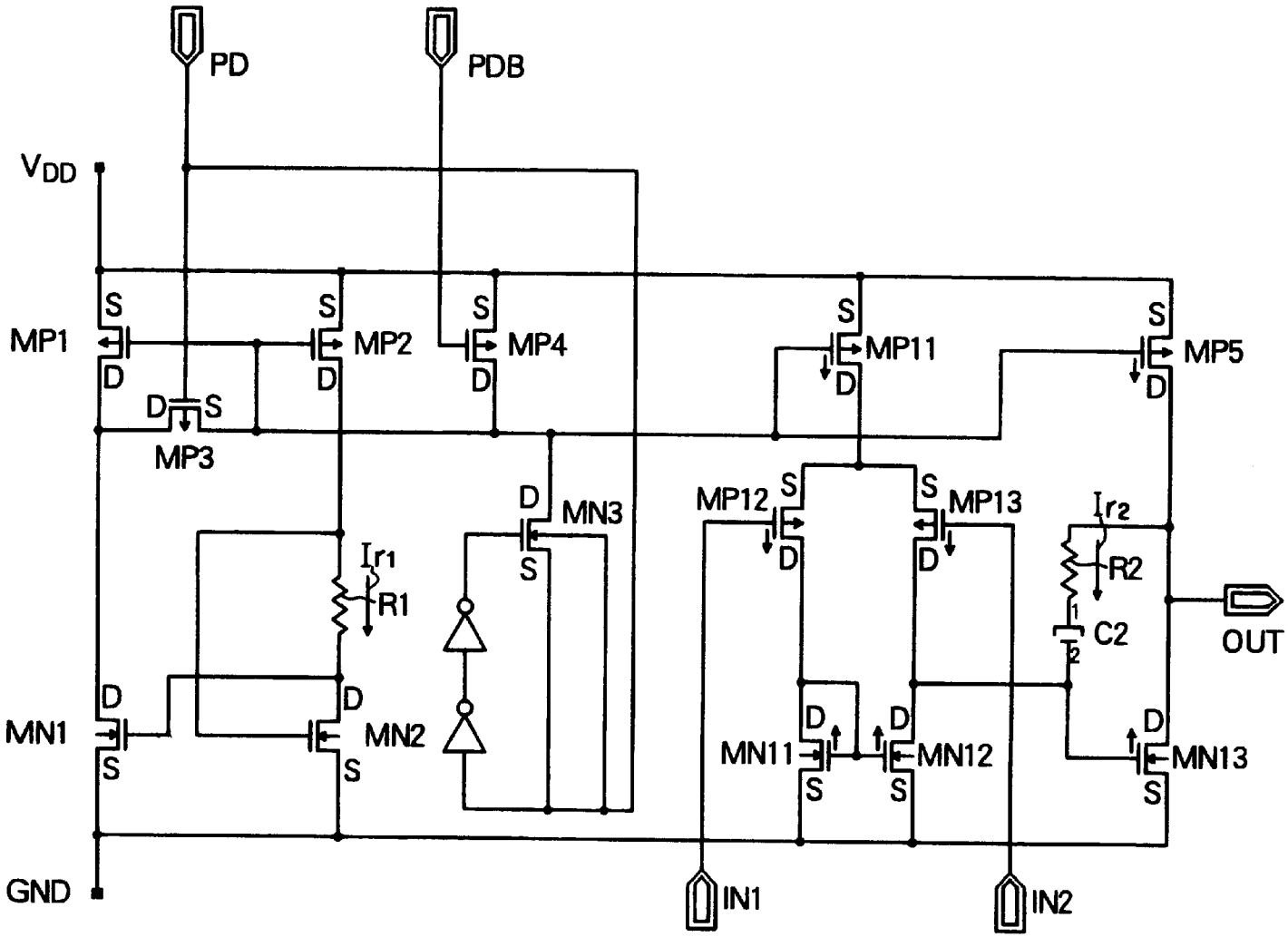
FIG. 3 is a circuit diagram showing the construction of an operational amplifier incorporating the constant current circuit shown in FIG. 1.

FIG. 3 is a circuit diagram of another embodiment of the invention in which the start circuit of FIG. 1 is applied to an operational amplifier having a constant current circuit.

The operational amplifier has an amplifying circuit which includes a p-channel MOS transistor MP11, with the gate connected to the bias point and the source connected to $V_{DD}$, to behave as the constant current source, paired p-channel MOS transistors MP12 and MP13 in a form of a pair of differential transistors, with their sources connected to the drain of the transistor MP11, and transistors MN11 and MN12 with their drains connected to the drains of the transistors MP12 and Mp13, their gates connected commonly, and their sources connected to ground. Its output circuit includes the transistor MP5 behaving as the constant current source, an n-channel MOS transistor MN13 with its drain connected to the drain of MP5 and its source connected to ground, and a resistor R2 and a capacitor C2 connected in series between the common connection point of the drains of MP5 and MN13 and the gate of the transistors MN13. Further, the connection point of the drain of the transistor MP13 and the drain of MN21 is connected to the gate of the transistor MN13, and the drain of MN13 is the output point OUT.

In this circuit, since the transistor MN13 and the delay circuit as the start circuit behave as in the same manner as explained with FIG. 1, the current flowing in the differential pair of operational amplifiers and the output circuit is a constant current, and a stable operational amplifier output can be realized.

Figure 4:
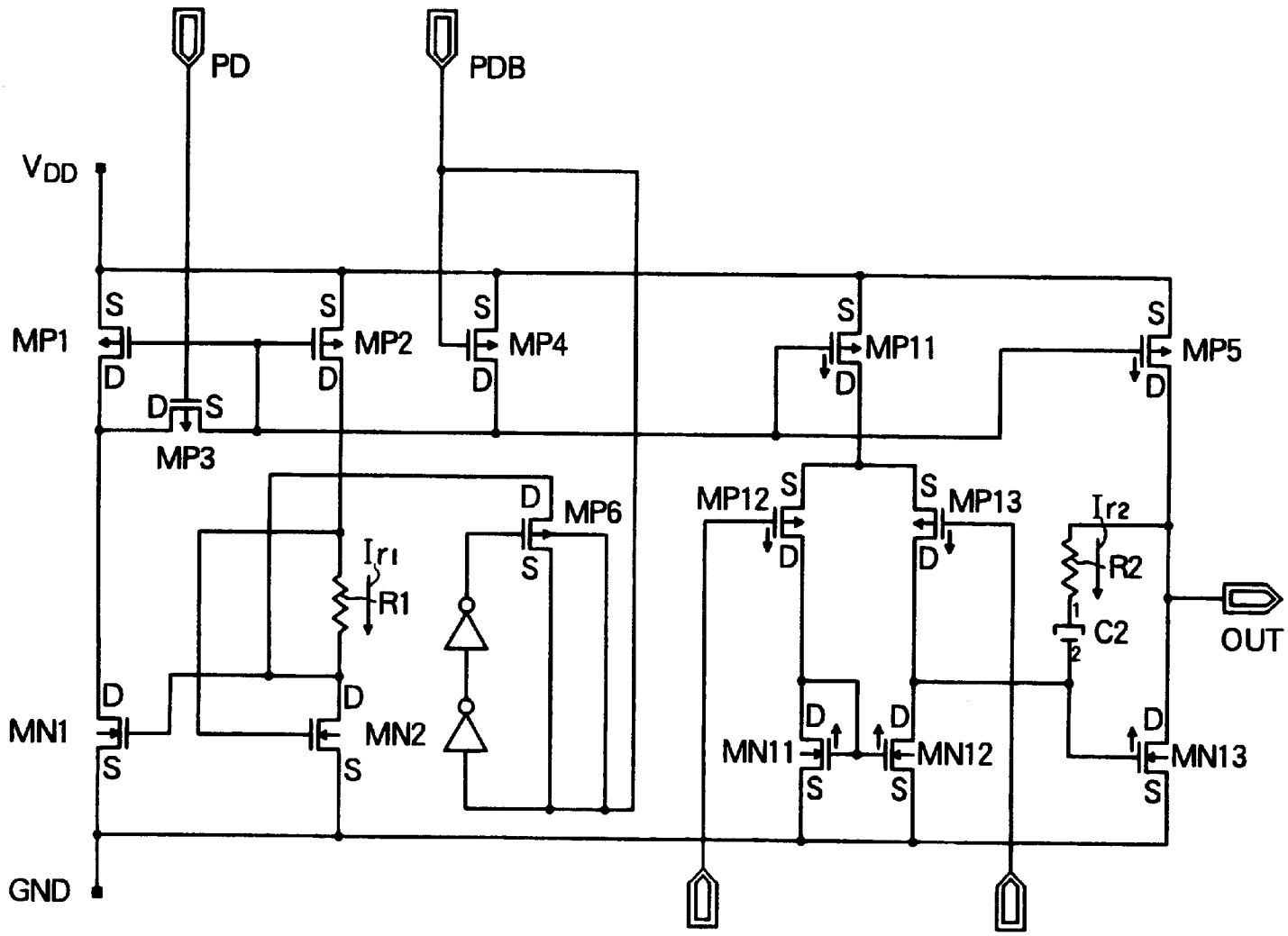
FIG. 4 is a circuit diagram showing the construction of an operational amplifier incorporating the constant current circuit shown in FIG. 2.

FIG. 4 shows a circuit based on the operational amplifier of FIG. 3 FIG. 2. Since the t circuit shown in FIG. 2. Since the construction and operations of the circuit are the same as those of FIGS. 2 and 3, explanations thereof will be omitted.

Figure 5:
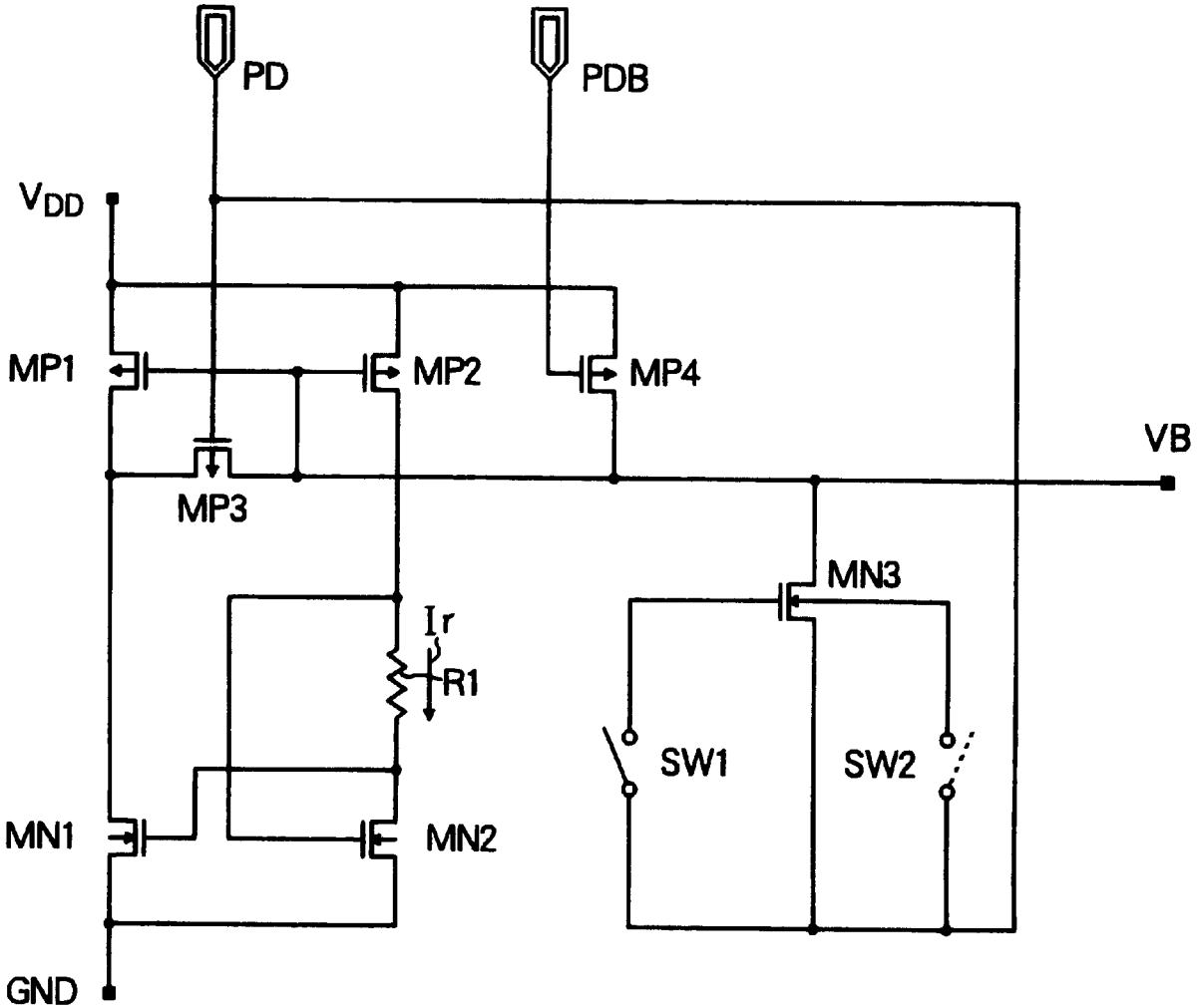
FIG. 5 is a circuit diagram showing the construction of a start device of a constant current circuit, according to the third embodiment of the invention.
Figure 6:
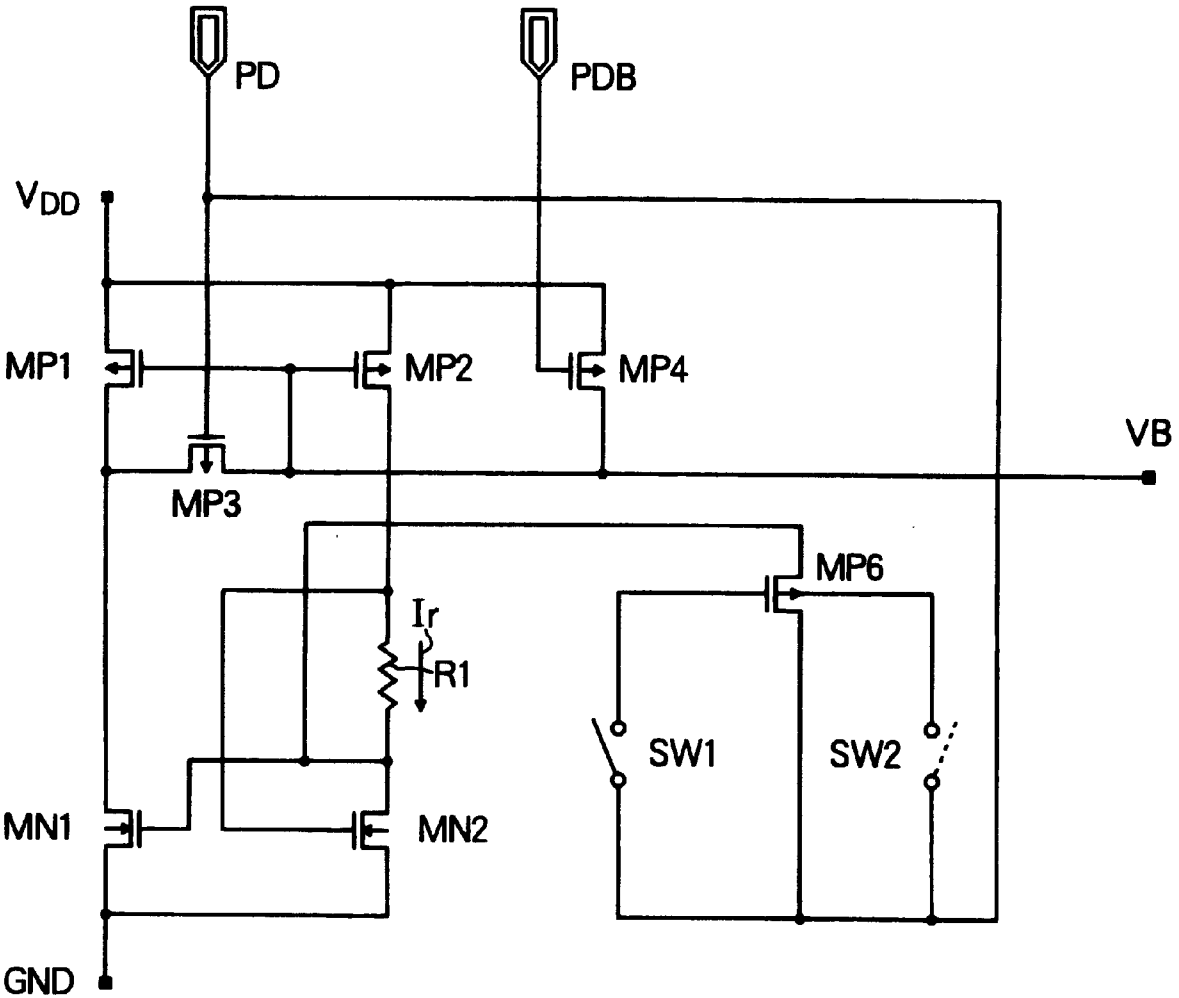
FIG. 6 is a circuit diagram showing the construction of a start device of a constant current circuit, according to the fourth embodiment of the invention.
Figure 7:
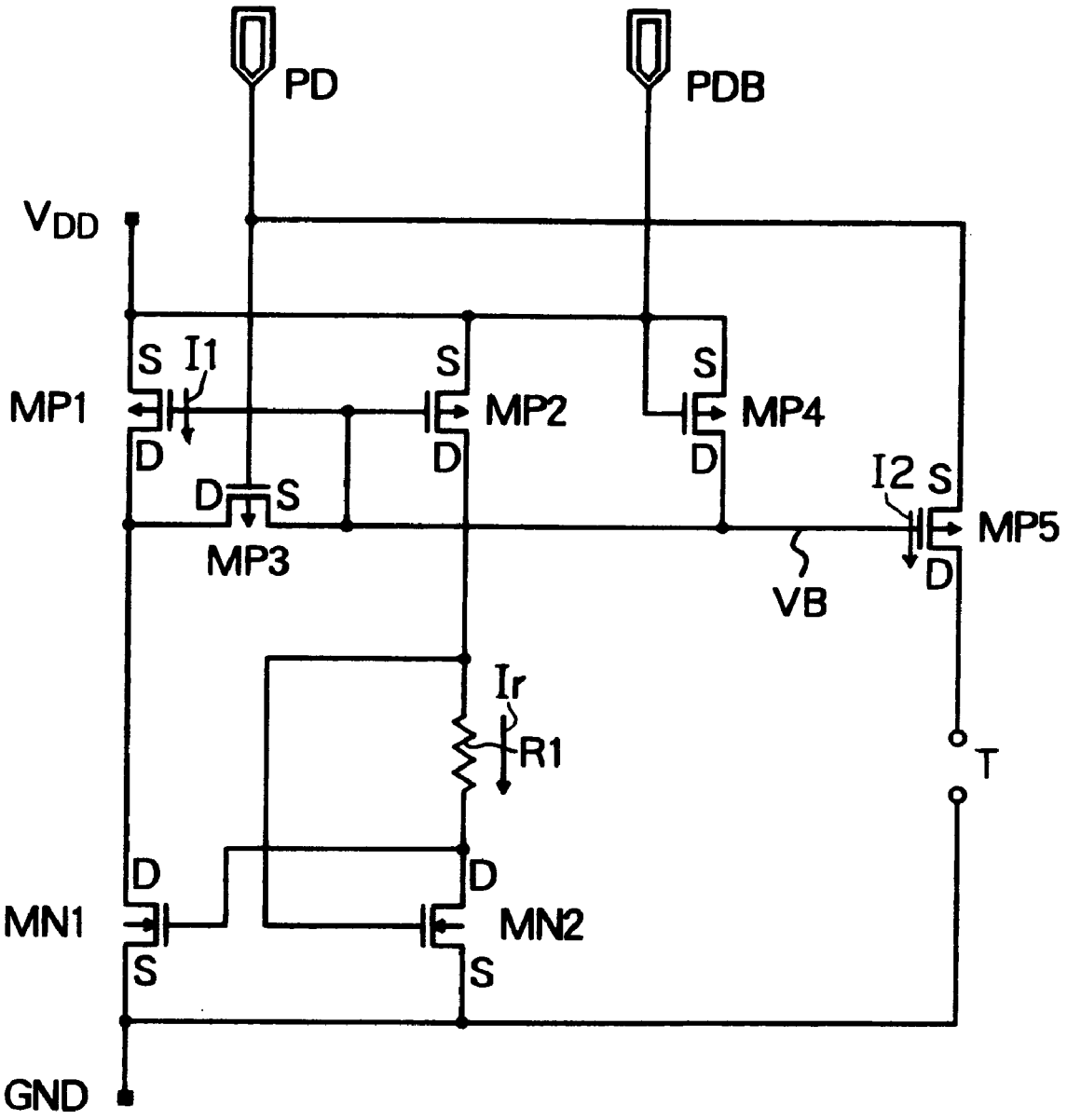
FIG. 7 PRIOR ART
FIG. 7 is a circuit diagram showing the construction of a conventional self-biasing constant current circuit.

FIGS. 5 and 6 show modified versions of the start circuit. These circuits are based on those of FIGS. 1 and 2 and use a switch SW1 in lieu of the delay circuit DL. The switch SW1 is closed in the activated state of the circuit and opened in the inactivated state. The changeover of the switch SW1 occurs slightly later than a change from signal PD to PDB, or vice versa.

In the circuit of FIG. 5, for example, when Pd changes from "H" to "L" and PDB from "L" to "H", the source of the transistor MN3 and the substrate become "L". However, before the switch SW1 closes, the gate does not change to "L", and the transistor MN3 remains conductive. Thus, the bias potential VB is pulled to the "L" potential. As a result, the transistors MP1 and MP2 are turned on, and a current begins to flow in the circuit. After that, when the switch SW1 is closed and causes the gate of the transistor MN3 to change to "L", the transistor MN3 is turned off, and the bias potential VB is stabilized in the constant status.

When PD changes from "L" to "H" and PDB from "H" to "L", the source of the transistor MN3 and the substrate become "H", and the gate gradually changes from "L" to "H" after the switch is opened, maintaining the transistor MN3 off for a while. Therefore, the circuit is quickly changed to the power-down status.

Also the circuit of FIG. 6 behaves in the same manner, and it is known that the switch SW1 functions as a delay circuit.

In FIGS. 5 and 6, a switch SW2 for controlling the substrate potential may be provided instead of using the switch SW1 for the gate of the transistor behaving as the start circuit. Note, however, that control of the substrate potential may be restricted depending on the substrate structure.

As explained above, the self-biasing constant current circuit starting device, constant current circuit and operational amplifier according to the invention are configured to reliably start the circuit by using a delay, or the like, and momentarily lowering the bias node, and therefore do not need a large capacitor and prevent entry of noise through the capacitor.

What is claimed is:

1. A start circuit for a self-biasing constant current including first and second MOS transistors of same conduction type, gates thereof being commonly connected to form a current mirror circuit, sources thereof being commonly connected to a power supply terminal, and bias setting means for setting the potential of a common connection point of the gates of said first and second MOS transistors to a predetermined bias potential;

said start circuit comprising:

a control transistor for controlling the potential of said common connection point, a drain thereof connected to a drain of said first MOS transistor, a source thereof being connected to a source of said second MOS transistor and said common connection point, and a gate thereof being supplied a power down signal; and control means for controlling said control transistor such that said control transistor is placed in a low impedance state to once pull down the potential of said common connection point to a reference potential for starting the constant current circuit and is then placed in a high impedance state, wherein said control means is a switch means operated later than a start timing, said control means being connected to a gate of said control transistor and a substrate terminal.

2. The start circuit according to claim 1, wherein said control means is a delay circuit.

3. The start circuit for a constant current circuit according to claim 2, wherein said delay circuit includes an even number of inverters connected in series.

4. A self-biasing constant current circuit comprising:

first and second MOS translators of a same conduction type, gates thereof being commonly connected to form a current mirror circuit, sources thereof being commonly connected to a power supply terminal;

bias setting means for setting the potential of a common connection point of the gates of said first and second MOS transistors to a predetermined bias potential; and a start circuit including:

a control transistor for controlling the potential of said common connection point, a drain thereof being connected to a drain of first said MOS transistor, a source thereof being connected to a source of said second MOS transistor and said common connection point, and a gate thereof being supplied a power down signal; and control means for controlling said control transistor such that said control transistor is placed in a low impedance state to once pull down the potential of said common connection point to a reference potential for starting the constant current circuit and is then placed in a high impedance state,wherein said control means is a switch means operated later than a start timing, said control means being connected to a gate of said control transistor and a substrate terminal.

5. A start circuit for a constant current circuit, comprising:

a first transistor of a first conduction type in which the source is connected to a first power source;

a second transistor of the first conduction type in which the gate is connected to the gate of said first transistor and the source is connected to the source of said first transistor;

a third transistor of the first conduction type in which the drain is connected to the drain of said first transistor, the source is connected to the common connection point of the gates of said first and second transistors, and the gate is supplied with and inactivation signal;

a fourth transistor of the first conduction type in which the source is connected to said first power source, the drain is connected to a bias point which is said gate common connection point, and the gate is supplied with an inverted signal which is the inverted version of said inactivating signal;

a fifth transistor of a second conduction type in which the drain is connected to the drain of said first transistor and the source is connected to a second power source;

a sixth transistor of the second conduction type in which the drain is connected to the drain of said second transistor via a resistor, the source is connected to said second power source, the gate is connected to the connection point of said resistor and the drain of said second transistor, and the connection point of said resistor and the drain thereof is connected to the gate of said fifth transistor; and a seventh transistor of the second conduction type in which said inactivation signal is connected to a substrate terminal and the source, the drain is connected to said bias point, and the gate is supplied with said inactivation signal through a delay circuit.

6. The start circuit for a constant current circuit according to claim 5, wherein said delay circuit includes an even number of inverters connected in series.

7. A self-biasing constant current circuit comprising:

a first transistor of a first conduction type in which the source is connected to a first power source;

a second transistor of the first conduction type in which the gate is connected to the gate of said first transistor and the source is connected to the source of said first transistor;

a third transistor of the first conduction type in which the drain is connected to the drain of said first transistor, the source is connected to the common connection point of the gates of said first and second transistors, and the gate is supplied with an inactivation signal;

a fourth transistor of the first conduction type in which the source is connected to said first power source, the drain is connected to a bias point which is said gate common connection point, and the gate is supplied with an inverted signal which is the inverted version of said inactivating signal;

a fifth transistor of a second conduction type in which the drain is connected to the drain of said first transistor and the source is connected to a second power source;

a sixth transistor of the second conduction type in which the drain is connected to the drain of said second transistor via a resistor, the source is connected to said second power source, the gate is connected to the connection point of said resistor and the drain of said second transistor, and the connection point of said resistor and the drain thereof is connected to the gate of said fifth transistor;

a seventh transistor of the second conduction type in which said inactivation signal is connected to a substrate terminal and the source, the drain is connected to said bias point, and the gate is supplied with said inactivation signal through a delay circuit; and an eighth transistor of the first conduction type in which the gate is connected to said bias point, the source is connected to said first power source, and the drain is connected to said second power source via a load, said eighth transistor and said first transistor forming a current mirror circuit.

8. The constant current circuit according to claim 7 wherein said delay circuit includes an even number of inverters connected in series.

9. An operational amplifier comprising:

a constant current circuit having a first transistor of a first conduction type in which the source is connected to a first power source; a second transistor of the first conduction type in which the gate is connected to the gate of said first transistor and the source is connected to the source of said first transistor; a third transistor of the first conduction type in which the drain is connected to the drain of said first transistor, the source is connected to the common connection point of the gates of said first and second transistors, and the gate is supplied with an inactivation signal; a fourth transistor of the first conduction type in which the source is connected to said first power source, the drain is connected to a bias point which is said gate common connection point, and the gate is supplied with an inverted signal which is the inverted version of said inactivating signal; a fifth transistor of a second conduction type in which the drain is connected to the drain of said first transistor and the source is connected to a second power source; a sixth transistor of the second conduction type in which the drain is connected to the drain of said second transistor via a resistor, the source is connected to said second power source, the gate is connected to the connection point of said resistor and the drain of said second transistor, and the connection point of said resistor and the drain thereof is connected to the gate of said fifth transistor; a seventh transistor of the second conduction type in which said inactivation signal is connected to a substrate terminal and the source, the drain is connected to said bias point, and the gate is supplied with said inactivation signal through a delay circuit; and an eighth transistor of the first conduction type in which the gate is connected to said bias point, the source is connected to said first power source, and the drain is connected to said second power source via a load, said eighth transistor and said first transistor forming a current mirror circuit;

ninth and tenth transistors supplied with first and second inputs as gate inputs thereof and forming a differential pair; and an output circuit, said constant current circuit being used as the constant current source of said ninth and tenth transistors and as the constant current source of said output circuit.

10. A start circuit for a constant current circuit, comprising:

a first transistor of a first conduction type in which the source is connected to a first power source;

a second transistor of the first conduction type in which the gate is connected to the gate of said first transistor and the source is connected to the source of said first transistor;

a third transistor of the first conduction type in which the drain is connected to the drain of said first transistor, the source is connected to a common connection point of the gates of said first and second transistors, and the gate is supplied with an inactivation signal;

a fourth transistor of the first conduction type in which the source is connected to said first power source, the drain is connected to a bias point which is said gate common connection point, and the gate is supplied with an inverted signal which is an inverted version of said inactivating signal;

a fifth transistor of a second conduction type in which the drain is connected to the drain of said first transistor and the source is connected to a second power source;

a sixth transistor of the second conduction type in which the drain is connected to the drain of said second transistor through a resistor, the source is connected to said second power source, the gate is connected to the connection point of said resistor and the drain of said second transistor, and the connection point of said resistor and the drain thereof is connected to the gate of said fifth transistor; and a seventh transistor of the second conduction type in which said inactivation signal is connected to a substrate terminal and the source, the drain is connected to the common connection point of the gates of said first and second transistors, and the gate is supplied with said inverted version of said inactivation signal through a delay circuit.

11. The start circuit for a constant current circuit according to claim 10, wherein said delay circuit is an even number of inverters connected in series.

12. A self-biasing constant current circuit comprising:

a first transistor of a first conduction type in which the source is connected to a first power source;

a second transistor of the first conduction type in which the gate is connected to the gate of said first transistor and the source is connected to the source of said first transistor;

a third transistor of the first conduction type in which the drain is connected to the drain of said first transistor, the source is connected to a common connection point of the gates of said first and second transistors, and the gate is supplied with an inactivation signal;

a fourth transistor of the first conduction type in which the source is connected to said first power source, the drain is connected to a bias point which is said gate common connection point, and the gate is supplied with an inverted signal which is an inverted version of said inactivating signal;

a fifth transistor of a second conduction type in which the drain is connected to the drain of said first transistor and the source is connected to a second power source;

a sixth transistor of the second conduction type in which the drain is connected to the drain of said second transistor through a resistor, the source is connected to said second power source, the gate is connected to the connection point of said resistor and the drain of said second transistor, and the connection point of said resistor and the drain thereof is connected to the gate of said fifth transistor;

a seventh transistor of the second conduction type in which said inverted version of the inactivation signal is connected to a substrate terminal and the source, the drain is connected to the common connection point of the gates of said first and second transistors, and the gate is supplied with said inverted version of the inactivation signal through a delay circuit; and an eighth transistor of the first conduction type in which the gate is connected to said bias point, the source is connected to said first power source, and the drain is connected to said second power source via a load, said eighth transistor and said first transistor forming a current mirror circuit.

13. The self-biasing constant current circuit according to claim 12, wherein said delay circuit is an even number of inverters connected in series.

14. An operational amplifier comprising:

a constant current circuit having a first transistor of a first conduction type in which the source is connected to a first power source; a second transistor of the first conduction type in which the gate is connected to the gate of said first transistor and the source is connected to the source of said first transistor; a third transistor of the first conduction type in which the drain is connected to the drain of said first transistor, the source is connected to a common connection point of the gates of said first and second translators, and the gate is supplied with an inactivation signal; a fourth transistor of the first conduction type in which the source is connected to said first power source, the drain is connected to a bias point which is said gate common connection point, and the gate is supplied with an inverted signal which is an inverted version of said inactivating signal; a fifth transistor of a second conduction type in which the drain is connected to the drain of said first transistor and the source is connected to a second power source; a sixth transistor of the second conduction type in which the drain is connected to the drain of said second transistor through a resistor, the source is connected to said second power source, the gate is connected to the connection point of said resistor and the drain of said second transistor, and the connection point of said resistor and the drain thereof to connected to the gate of said fifth transistor; a seventh transistor of the second conduction type in which said inverted version of the inactivation signal is connected to a substrate terminal and the source, the drain is connected to the common connection point of the gates of said first and second transistors, and the gate is supplied with said inverted version of the inactivation signal through a delay circuit; and an eighth transistor of the first conduction type in which the gate is connected to said bias point, the source is connected to said first power source, and the drain is connected to said second power source through a load, said eighth transistor and said first transistor forming a current mirror circuit;

ninth and tenth transistors supplied with first and second inputs as gate inputs thereof and forming a differential pair; and an output circuit, said constant current circuit being used as the constant current source of said ninth and tenth transistors and as the constant current source of said output circuit.

* * * * *